US007128238B2

(12) United States Patent
Runnels

(10) Patent No.: US 7,128,238 B2
(45) Date of Patent: Oct. 31, 2006

(54) APPARATUS FOR DISPENSING FLAT ITEMS

(76) Inventor: Frank Runnels, 7815 Hartwell St., Dearborn, MI (US) 48126

( * ) Notice: Subject to any disclaimer, the term of this patent is extended or adjusted under 35 U.S.C. 154(b) by 200 days.

(21) Appl. No.: 11/067,450

(22) Filed: Feb. 25, 2005

(65) Prior Publication Data

US 2005/0211722 A1 Sep. 29, 2005

Related U.S. Application Data

(62) Division of application No. 10/811,514, filed on Mar. 29, 2004.

(60) Provisional application No. 60/326,300, filed on Oct. 1, 2001.

(51) Int. Cl.
*B65H 1/00* (2006.01)

(52) U.S. Cl. ..... 221/198; 221/232

(58) Field of Classification Search ..... 221/232, 221/131, 124, 197, 198, 268, 155, 6
See application file for complete search history.

(56) References Cited

U.S. PATENT DOCUMENTS

| | | | | |
|---|---|---|---|---|
| 2,673,133 | A * | 3/1954 | Koch | 221/271 |
| 4,886,325 | A * | 12/1989 | Rockola et al. | 312/138.1 |
| 5,265,760 | A * | 11/1993 | Harris et al. | 221/197 |
| 5,335,822 | A | 8/1994 | Kasper | |
| 5,706,976 | A * | 1/1998 | Purkey | 221/6 |
| 5,743,605 | A * | 4/1998 | Marino | 312/211 |
| 5,996,841 | A | 12/1999 | Marrocco | |
| 6,227,441 | B1 * | 5/2001 | Sagel et al. | 229/117.35 |

* cited by examiner

*Primary Examiner*—Kenneth Noland
(74) *Attorney, Agent, or Firm*—MacMillan, Sobanski & Todd, LLC

(57) ABSTRACT

A vending machine for dispensing flat items includes a housing having a removable collection pan with a pan bag, a door with display windows, a coin slide mechanism extending through the door and a folder slide mounted on the inside of the door. The folder slide releasably retains either a tower or a shipping/dispensing box for holding a column of the flat items to be dispensed through a slot in the door.

18 Claims, 6 Drawing Sheets

APPARATUS FOR DISPENSING FLAT ITEMS

CROSS-REFERENCE TO RELATED APPLICATION

This application claims benefit of U.S. provisional patent application Ser. No. 60/326,300 filed Oct. 1, 2001 and PCT application PCT/US02/31140, filed Oct. 1, 2002, and is a divisional application of U.S. nonprovisional application Ser. No. 10/811,514, filed Mar. 29, 2004.

BACKGROUND OF THE INVENTION

The present invention relates generally to a vending apparatus for dispensing flat items such as stickers and temporary tattoos.

Sticker vending machines are used for dispensing items such as stickers and temporary tattoos to consumers. The stickers are usually applied on the pages of sticker albums or to the surfaces of books and other objects for display. The temporary tattoos are usually applied to the user's skin to simulate a conventional tattoo. Herein, the term "sticker" is used to denote a sticker, a temporary tattoo and any similar flat item to be vended.

Prior art sticker vending machines present many problems related to reliable operation and servicing. Typically, each sticker is retained in a flat cardboard folder which folders are assembled in packs of thirty stacked and held together by an elastic band. Ten packs of stickers in folders are then placed in a box for delivery to a vending machine service person. Conventional vending machines for stickers are constructed such that the service person removes the elastic band from a pack and inserts the thirty sticker folders into a metal tower in the machine. The machines typically have from one to four or six towers fixed in place with the two and four tower machines being the most common. The towers are either carried on the vending machine door for machines serviced from the front, or are mounted inside the machine body in machines that are serviced from the rear. In either case the sticker folders are retained in vertical stacks with each folder extending in a generally horizontal plane. In a typical sticker folder vending machine, a gravity biased metal plate is placed on top of the stack of sticker folders in the tower. In order to service a prior art sticker vending machine, the service person must first remove the old stickers from the towers, put the old stickers in small stacks place elastic bands around the small stacks and place the stacks in boxes to transport them. Then the service person can perform the above-described tower filing procedure. This is a time consuming task.

The conventional sticker folder vending machine has a front wall or door on which is mounted a three-sided frame open at the top for receiving a display card or sheet holding displays depicting the stickers to be dispensed. The frame also retains a clear cover, typically plastic, in front of the display sheet. When the stickers in the towers are changed, the service person must remove the cover and the sheet by sliding them upwardly and out the open top of the frame. Then the old displays are removed from the sheet and new displays are taped in place. Now the cover and the display sheet are inserted back into the frame.

The prior art sticker vending machine has a coin slide positioned adjacent the bottom of the tower. While most vending machines require the insertion of at least one coin for operation, in some instances the coin slides are adapted to be operated with special tokens or freely without coins. Prior art vending machines having a collection pan for the coins present a problem since a person servicing the machine is required to remove the pan and empty the collected coins into a canvas collection bag. The operation of holding a collection bag open while tilting the collection pan to pour the coins into the bag is difficult to perform, especially while standing in a crowded area, and often results in spills and wasted time.

As is evident from the discussion above, the normal service routine for a prior art sticker vending machine is time consuming and has many related problems. It can take the average service person from twenty to thirty minutes to change the stickers and displays in and collect the coins from one sticker vending machine.

Other problems associated with prior art sticker vending machines are related to mechanisms for receiving the coins and dispensing the stickers. When the vending machine customer inserts coins into the coin slide, and then pushes the slide into the machine, a dispensing mechanism on the inner end of the slide engages the bottom sticker folder in the stack. The dispensing mechanism in a typical sticker machine includes a stripper or pusher that engages the rear edge of the bottom folder and pushes that folder through an opening in the front wall of the tower to dispense that folder. Thus, as the customer pulls the slide out of the machine, the bottom folder is dispensed, and the metal plate on top of the stack urges the remaining folders downward replacing the just dispensed folder.

In type of problem, one or more stickers will become jammed in the dispensing mechanism. In another type of problem, a bent or damaged coin will hang up the coin slide. In either case, the service person must remove the associated tower from the machine to make a repair. In a front loading machine, the door must be lowered to approximately 20° below horizontal to access the screws holding the tower in place. Unless the stickers are first removed from the tower, they will tumble out when the door is lowered. Removing the stickers in a busy area and finding a place to stack them so that they will not fall over is time consuming.

One cause of the sticker jamming problems associated with the prior art sticker vending machines is related to the mechanisms for dispensing one sticker at a time and the anti-theft measures incorporated therein. A piece of spring steel is located adjacent a vertically narrow dispensing slot to limit the number of stickers dispensed usually to one at a time. Some "customers" use a sharp instrument to pick stickers out through the dispensing slot without using coins. The steel piece also functions as a security gate to prevent stickers from being picked out through the slot. A hinged security gate with a return spring can be provided in place of the steel piece. In some instances the sticker being dispensed drags a second sticker along and they become wedged in the security gate and/or the dispensing slot. In other instances, the "customer" uses a screwdriver to pry open the security gate thereby damaging it and causing a jamming problem. These jamming problems require the time-consuming service procedure outlined above.

SUMMARY OF THE INVENTION

The present invention concerns an apparatus for dispensing flat items such as stickers and temporary tattoos. The apparatus includes a housing having a front wall with an upper door opening at least one intermediate dispensing slot and a lower pan opening formed therein. A collection pan is releasably retained in the pan opening and extends inside the housing with a pan bag removably retained therein for receiving coins. A door is positioned in the door opening and is pivotally attached to the front wall for movement between open and closed positions. At least one coin slide mechanism is mounted on the door and is operable to transfer at least one coin from outside the housing to the pan bag. The apparatus further includes a storage means removably mounted on an inside surface of the door for holding a plurality of the flat items in a column. A folder slide is mounted on an inside surface of the door adjacent the storage means and is coupled to the coin slide mechanism. When the coin slide mechanism is operated to transfer at least one coin from outside the housing to the pan bag, the coin slide mechanism actuates the folder slide to push the lowermost flat item at least partially out of the at least one dispensing slot.

The collection pan has a tab adapted to extend through a slot formed in a rear wall of the housing for receiving a padlock. The pan bag includes a pan shaped bag having a bottom wall with a bag opening formed therein and a pocket shaped bag attached to the bottom wall in communication with the bag opening. The pan bag includes a cord having opposite ends attached to opposed side walls of the pan shaped bag for lifting the pan bag from the collection pan causing coins in the pan shaped bag to fall into the pocket shaped bag.

The storage means can be a tower or a shipping/dispensing box. A weight having a metal plate and attached handle is removably retained in the storage means for resting on top of the column of flat items. The shipping/dispensing box can have a predetermined number of the flat items therein and an indicator means for indicating at least one of a number of the flat items in the box and a number of the flat items dispensed from the box. The box has a pair of opposed side walls each having a plurality of tabs formed therein, each tab being adapted to be pushed inwardly. As an alternative, the side walls each have a retainer strip attached thereto, each retainer strip having a plurality of teeth formed thereon.

The folder slide includes a vertically extending bias plate positioned adjacent to the at least one dispensing slot for contacting the flat item being dispensed. The bias plate can be made of a flexible material such as spring steel or neoprene. The shipping/dispensing box has a bottom wall for supporting the column of flat items, the bottom wall having a cutout and a pair of apertures formed therein. The folder slide has a pair of flanges extending into the cutout and a pair of posts extending into the aperture whereby the lowermost flat item is supported by the flanges and the posts.

DESCRIPTION OF THE DRAWINGS

The above as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
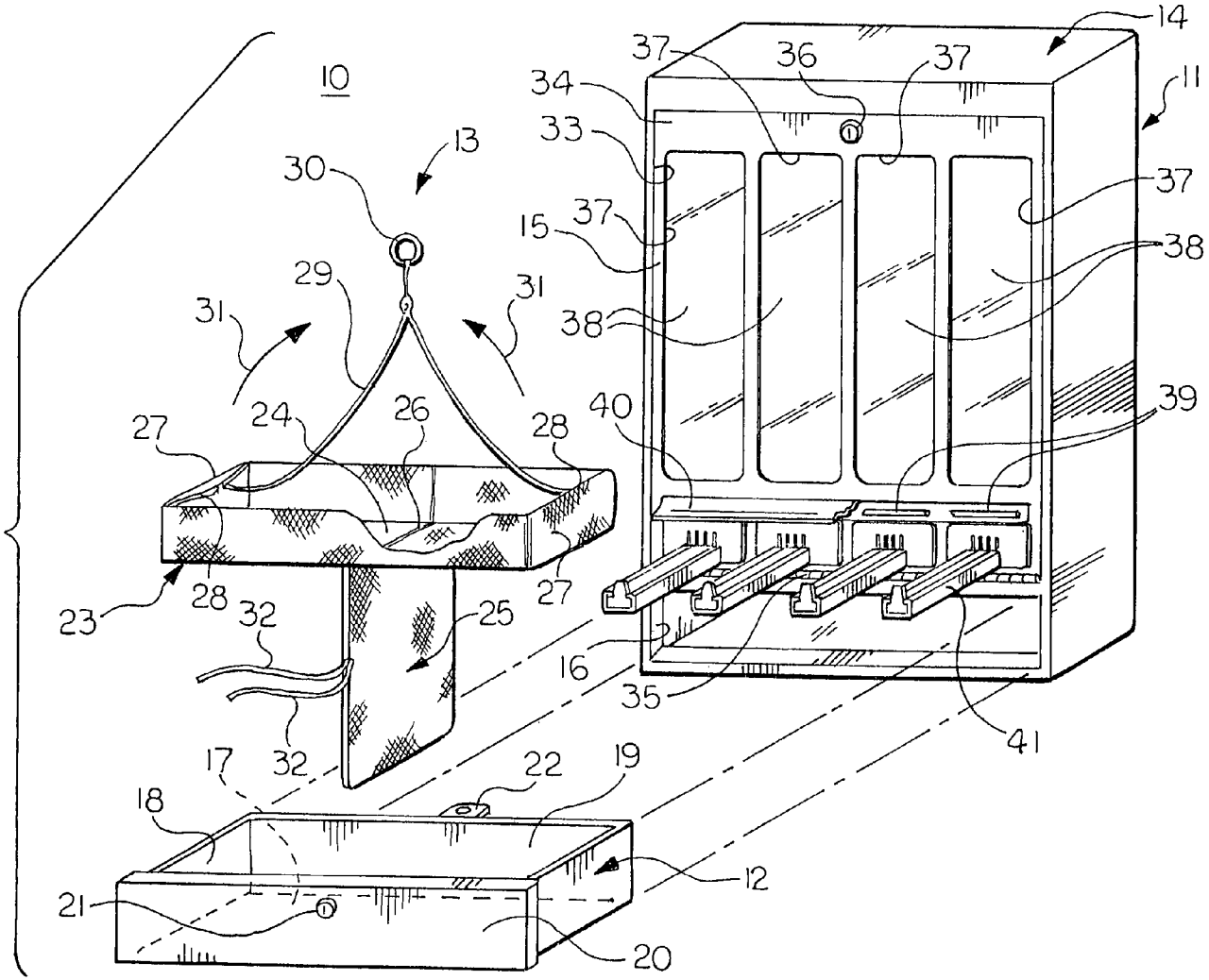
FIG. 1 is an exploded perspective view of an apparatus for dispensing flat items in accordance with the present invention.

There is shown in FIG. 1 a vending machine 10 according to the present invention for dispensing flat items such as stickers and temporary tattoos in exchange for coins. The vending machine 10 includes a storage and dispensing apparatus or assembly 11, a collection pan 12 and a pan bag 13. The assembly 11 has a generally rectangular hollow housing 14 with a generally vertical front wall 15 having a pan opening 16 formed adjacent a bottom edge of the wall. The pan opening 16 is sized to receive the collection pan 12 having a bottom wall 17 attached to and surrounded by upstanding walls. The pan 12 has a pair of side walls 18 each extending between a rear wall 19 and a slightly larger front wall 20. A conventional key-actuated first lock 21 is mounted in the pan front wall 20 for cooperation with an inner surface of the housing front wall 15 to prevent removal of the collection pan 12 from the housing when the lock is locked. As a further security means, an apertured tab 22 extends rearwardly from an upper edge of the pan rear wall 19. When the collection pan 12 is positioned in the housing 14, the tab 22 extends through a slot (not shown) formed in a rear wall of the housing and a padlock can be engaged with the aperture in the tab.

Prior art vending machines having a collection pan present a problem since a person servicing the machine is required to remove the pan and empty the collected coins into a canvas collection bag. The operation of holding a collection bag open while tilting the collection pan to pour the coins into the bag is difficult to perform, especially while standing in a crowded area, and often results in spills and wasted time. The pan bag 13 according to the present invention provides a solution to the prior art problem. The pan bag 13 is made of canvas, or other stiff but flexible material, and consists of two portions joined together by sewing or other means. A pan shaped bag 23 has a bottom wall 24 from which a pocket shaped bag 25 extends downwardly. An opening 26 is formed in the bottom wall 24 for communication between the interior of the bag 23 and the interior of the bag 25. When the pan bag 13 is placed in the collection pan 12, the pocket shaped bag 25 folds under the bag bottom wall 24 to lie flat on the pan bottom wall 17 permitting the collection pan 12 to be fully inserted into the housing 14 at the pan opening 16.

The pan shaped bag 23 has a pair of upstanding side walls 27 each with a loop type handle 28 attached to an inner surface thereof. A cord 29 has opposite ends attached to respective ones of the handles 28. A ring 30 is attached to the cord 29 between the ends thereof. When the pan bag 13 is in the collection pan 12, the cord 29 and the ring 30 lie on the bag bottom wall 24. When it is time to collect the coins that have been deposited in the pan shaped bag 23, the ring 30 is grasped and lifted causing the cord 29 to act through the handles 28 moving the side walls in a direction of arrows 31. As the side walls 27 move, the bag bottom wall 24 begins to fold at the opening 26 and any coins slide toward the opening. As the pan shaped bag 23 is further lifted, the pocket shaped bag 25 unfolds to the downward orientation shown in FIG. 1. The pan shaped bag 23 functions as a funnel to direct the coins through the opening 26 and into the pocket shaped bag 25. The pocket shaped bag 25 has a pair of strings 32 attached at a side edge near the bag bottom wall 26. When the pan shaped bag 23 is empty, the service person ties the strings 32 around the pocket shaped bag 25, thus securing the money and the collection process is finished. Although the pan bag 13 has been described in connection with the flat item vending machine 11, it can be used with other types of coin-operated machines.

The housing front wall 15 has a door opening 33 formed therein above the pan opening 16. A door 34 is mounted in the opening 33 and is pivotally attached to the housing front wall 15 by a hinge 35 connecting a lower edge of the door with a lower edge of the opening. A conventional key-actuated second lock 36 is mounted in the door 34 for cooperation with an inner surface of the housing front wall 15 to prevent opening of the door when the lock is locked. A plurality of vertically extending side-by-side display windows 37 is formed in the door 34. Although four windows 37 are shown, more or less can be used. A transparent plate 38 is mounted on the inside surface of the door 34 to close the display windows 37. The transparent plate 38 is made of a strong material, such as Lexan polycarbonate sheet material by General Electric; to restrict unauthorized access to the interior of the housing 14.

An individual dispensing slot 39 is formed in the door 34 below each of the windows 37 through which the flat items are dispensed. A downwardly extending flange 40 is attached to the outer surface of the door 34 just above the slots 39 and extends in front of the slots to direct the fiat items being ejected from the slots. The flange 40 also blocks direct access to the interior of the housing 14 through the slots 39. A separate two coin slide mechanism 41 of conventional construction is mounted below each slot 39. Although a two coin slide mechanism is shown, currently slide mechanisms from no coins to five coins are available and could be used for the slide mechanisms 41. The slide mechanisms 41 extend through the door 34 as described below.

Figure 2:
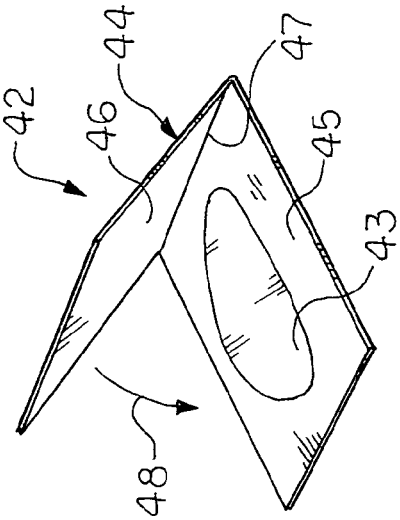
FIG. 2 is perspective view of a fiat item to be dispensed by the apparatus shown in FIG. 1.

FIG. 2 shows a typical flat item 42 to be dispensed by the vending machine 10 of FIG. 1. The flat item 42 includes a sticker 43 carried by a folder 44 of a size compatible with passing through one of the slots 39. The sticker 43 is shown resting on a bottom panel 45 of the folder 44. The folder includes a top panel 46 attached to the bottom panel 45 at a hinge 47 that can be formed by scoring a continuous sheet of material containing both of the panels. The sticker 43 is retained in the folder 44 by pivoting the upper panel 46 about the hinge 47 and into contact with the lower panel 45.

Figure 3:
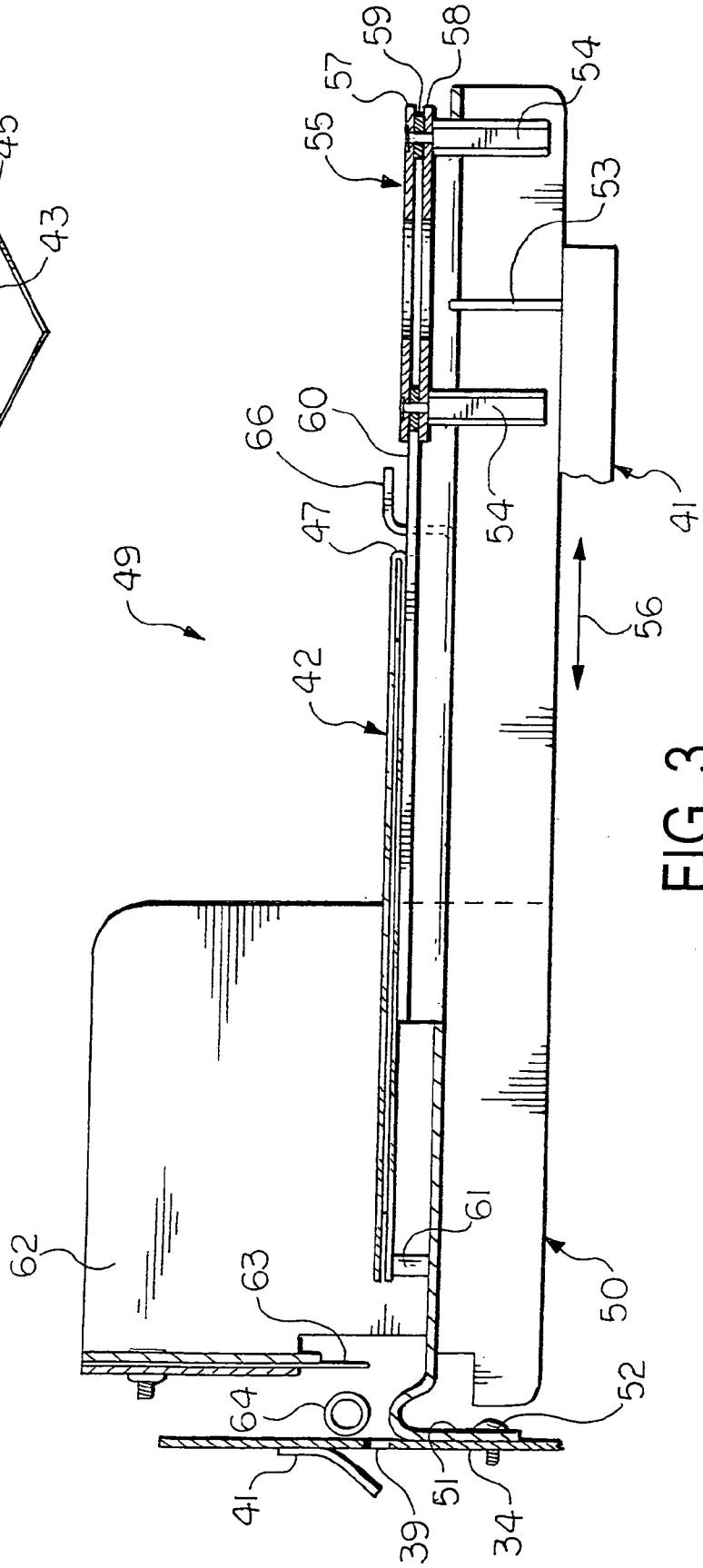
FIG. 3 is a cross-sectional side elevation view of a folder slide of the apparatus shown in FIG. 1.

FIG. 3 shows a folder slide 49 for dispensing the flat item 42 through an associated one of the dispensing slots 39 in the door 34. The slide 49 includes a longitudinally extending channel-shaped base 50 having a vertically extending mounting flange 51 formed at a front end thereof. The flange 51 is attached to an inner surface of the door 34 with a pair of fasteners 52 (only one is shown). An upper end of the flange 51 is curved adjacent the slot 39 for guiding the flat item 42 as it is dispensed. A back portion of the slide mechanism 41 includes an upwardly extending push/pull plate 53 attached thereto. The plate 53 is positioned between a pair of engagement posts 54 extending downwardly from a horizontally extending slider 55. As shown by a double-headed arrow 56, the slide mechanism 41 can move in a rearward direction to contact the back post 54 and move the slider 55 rearwardly and can move in a forward direction to contact the front post 54 and move the slider 55 forwardly.

The slider 55 includes a top plate 57 and a similarly dimensioned bottom plate 58 attached to opposite sides of a smaller spacer plate 59. The body 50 includes a pair of spaced apart horizontally extending guide flanges 60 (only one is shown). The guide flange 60 extends between the upper plate 57 and the lower plate 58 in the area created by the spacer plate 59 to permit the slider to slide in the directions indicated by the arrow 56. The top plate 57 can extend a full width of the distance between the outer surfaces of vertical legs of the guide flanges 61 while the bottom plate 58 is slightly narrower to accommodate the thickness of the legs. A rearward portion of the flat item 42 including the hinge 47 rests on an upper surface of each of the guide flanges 60. A forward portion of the flat item 42 rests on a pair of support posts 61 (only one is shown). When the slide mechanism 41 is moved forwardly, the slider 55 is pulled forwardly thereby and contacts the flat item 42 at the hinge 47 to push the flat item toward the dispensing slot 39.

In prior art vending machines, the fixed towers have a flat bottom wall upon which the column of stickers rests. As the lowermost flat item is being dispensed, there is considerable friction with the bottom wall which tends to make it more difficult to dispense. The guide flanges 60 and the posts 61 have much less contact area with the bottom surface of the flat item 42 resulting in less sliding friction making it easier to dispense.

The base 50 includes an upstanding U-shaped wall 62 having a downwardly extending bias plate 63 attached thereto and extending transverse to the direction of travel of the flat item. The bias plate 63 is made of a suitable resilient material such as thin spring steel or neoprene, or any other suitable material, to force the flat item into contact with the top or upwardly facing surface of the mounting flange 51. The bias plate 63 tends to prevent more than one flat item 42 from being dispensed and also functions as a security gate to protect against "picking" wherein someone inserts a "tool" through the slot 39 to pull out the flat items. A helical spring 64 extends the width of and is mounted on the door 34 just above the flange 51 such that the flat item 42 passes between the spring and the flange as it is pushed out of the slot 39. The spring 64 functions as a security gate to protect against "picking" and to prevent more than one flat item 42 from being dispensed. Thus, the bias plate 63 and the spring 64 can be used together or separately. However, neither the bias plate 53 formed of neoprene or an equivalent material nor the spring 64 will be damaged by a screwdriver, for example, used to pry open the security gate. When the slider 55 reaches the forward extent of its travel, the flat item 42 is partially extended from the slot 39 and is firmly held until it can be grasped and pulled from the vending machine 10.

The bias plate 63 made of neoprene, or a similar material, has the proper flexibility to restrict the dispensing to one flat at a time, but will pass more than one flat item to prevent a jam. As a second flat item is pulled along by the bottom flat item being dispensed, the bias plate 63 will apply a resistive force that tends to hold back the second flat item. However, if the two flat items don't separate, the bias plate 63 will flex enough to allow both flat items to pass into the dispensing slot 39 which is tall enough to accommodate both thereby preventing a jam. This anti-jamming feature also permits a change to the intentional dispensing of thicker folders 44 or two or more flat items 42 together without modifying the bias plate 63. The same functionality can be accomplished using the bias plate 63 made of spring steel with the spring 64. The spring 64 will tend to restrict the dispensing to one flat item, but will flex in an upward direction to permit thicker folders 44 or two or more of the flat items 42 together to pass without jamming.

Figure 4:
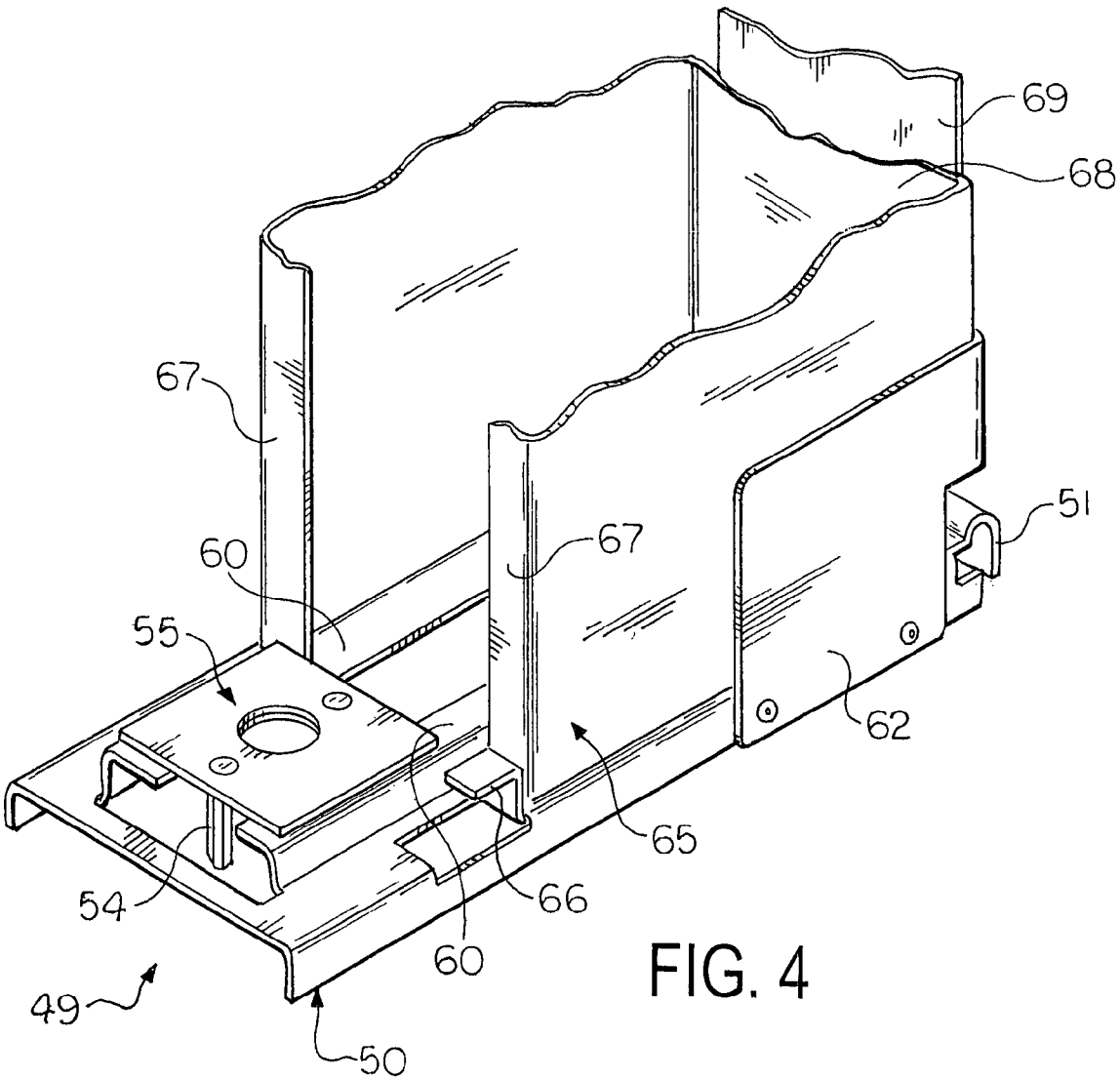
FIG. 4 is a fragmentary perspective view of the folder slide shown in FIG. 3 with an associated tower.
Figure 5:
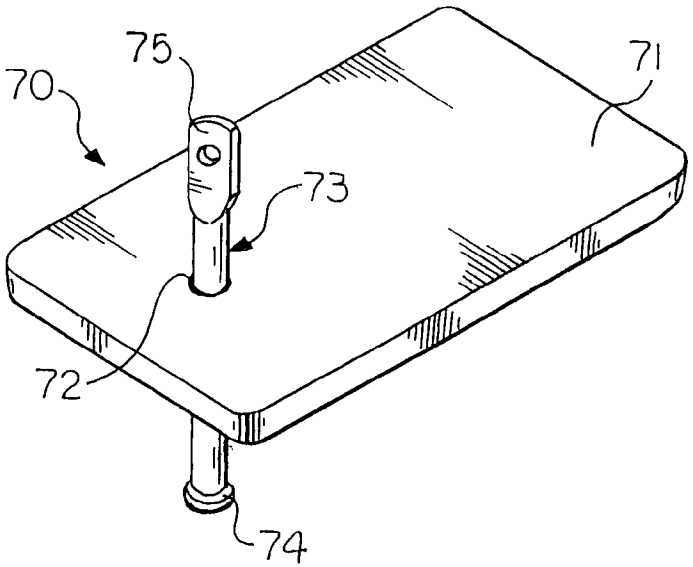
FIG. 5 is a perspective view of a column weight used with the apparatus shown in FIG. 1.

There is shown in FIG. 4 the folder slide 49 with a storage means in the form of an associated tower 65 removably resting on an upper surface of the base 50. The tower 65 is generally rectangular in profile and abuts the generally U-shaped wall 62 in front. The tower 65 is restrained from rearward movement by a stop 66 extending upwardly from the base 50. The guide flanges 60 extend into the interior of the tower 65 through a vertically extending opening in a rear wall 67 thereof and a horizontally extending opening in a bottom wall (not shown) thereof. The horizontally extending opening in the bottom wall extends from front to rear to accept the guide flanges 60 and the support posts 61 (FIG. 3). The opening is wider at the rear than the width of the slider top plate 57 and narrower than the top plate in the front. Thus the tower 65 can be installed and removed from the folder slide 49 when the slider 55 is in the position shown. Prior to actuation of the slide mechanism 41, the slider 55 is positioned at the front of the guide flanges 60 over the narrower portion of the tower bottom wall opening preventing removal of the tower 65. The tower 65 is made of metal and is sized to hold a column of the flat items 42 supported on the split bottom wall. When the tower 65 is installed on the folder slide 49, the guide flanges 60 and the support posts 61 extend through the opening and above the upper surface of the bottom wall of the tower to raise the column of flat items 42 above the bottom wall of the tower 61. The slider 55 will engage the flat item at the bottom of the column for dispensing the item through a slot (not shown) in a front wall 68 of the tower 65 to which a card-like display 69 can be attached. The display 69 depicts the various stickers being vended and can be observed through the associated display window 37 (FIG. 1). As an alternative, a larger display (not shown) can be mounted between the transparent plate 38 and the towers 65. Prior to operation of the coin slide, the slider 55 is positioned inside the tower 65 and extends over the forward end of the guide flanges 61 thereby overlapping the In order to assure that the column of flat items moves downwardly in the tower 65 as the bottom flat item is dispensed, a weight 70, as shown in FIG. 5, is provided. The weight 70 includes a metal plate 71 of substantial weight and having rounded corners to provide clearance in the corners of the tower 65. An aperture 72 is formed in the plate 71 and receives a rod-like handle 73. The handle 73 has a radially expanded lower end 74 of larger diameter than the aperture and a flattened upper end 75 of greater width than the diameter of the aperture. The upper end 75 has a shape suitable for grasping between a thumb and forefinger. When the last flat item 42 has been dispensed, the lower end 74 of the handle 73 drops into the central aperture in the slider 55 to prevent actuation of the coin slide mechanism 41 so that a customer will not lose money due to an empty storage means.

Figure 6:
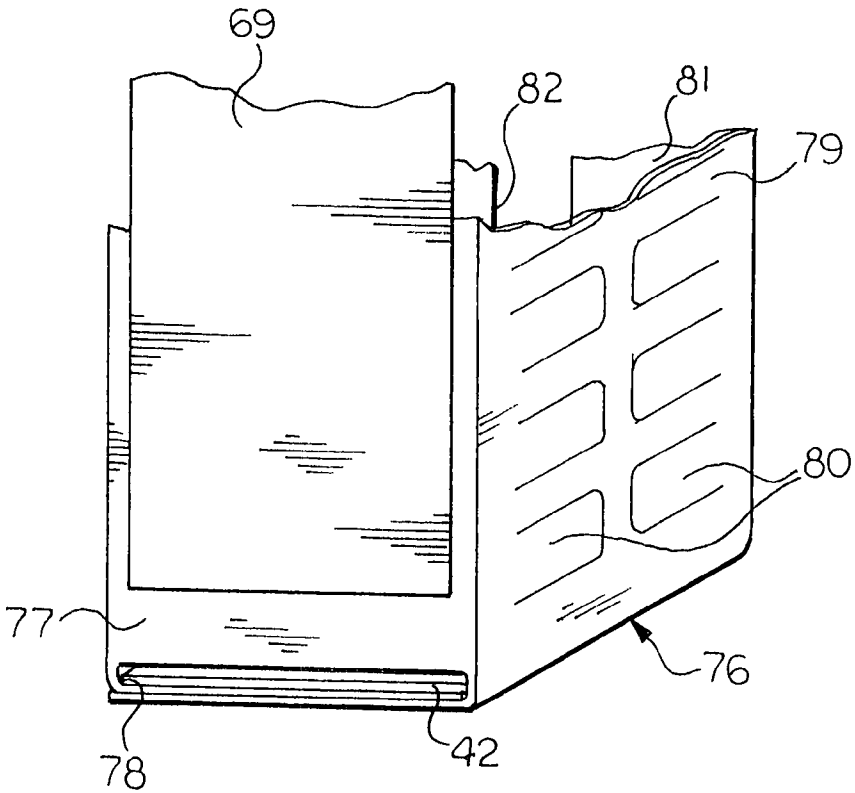
FIG. 6 is a fragmentary front perspective view of a lower end of a shipping and dispensing box used with the apparatus shown in FIG. 1.
Figure 7:
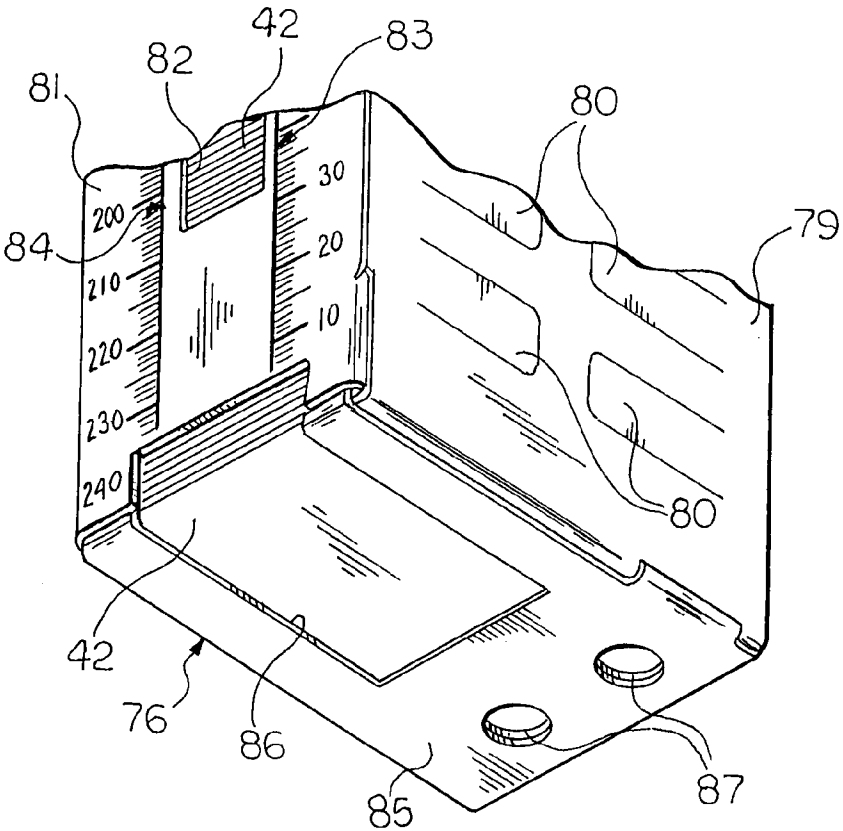
FIG. 7 is a fragmentary rear perspective view of the lower end of the shipping and dispensing box shown in FIG. 6.

There is shown in the FIGS. 6 and 7 a front and a rear of a shipping/dispensing box 76 for use as a flat item storage means with the present invention. One of the problems with the tower 65 is that the flat items 42 are shipped in a box assembled in packs of thirty stacked and held together by an elastic band. The vending machine service person must remove a pack from the shipping box, remove the elastic band from the pack and load the flat items into the open top of the tower 65. This process is repeated until the tower 65 has been filled with the desired number of flat items up to a maximum capacity. The shipping/dispensing box 76 solves this problem by functioning both as a shipping box and a dispensing tower.

The box 76 is formed of cardboard or similar material and is of the same rectangular profile as the tower 65 so as to cooperate with the wall 62 in front and the stop 66 in back. The box 76 has a front wall 77 on which the display 69 can be mounted, with tape or an adhesive backing, or to which individual stickers can be adhered. The display 69 or the individual stickers can be installed when the flat items 42 are packed in the box 76 prior to shipment. Thus, the tower, the column of flat items and the display are combined as a single unit to save the service person time. Typically, the boxes can be changed and the coins collected in less than five minutes. A slot 78 extends horizontally at the bottom of the front wall 77 through which the flat items 42 are pushed. A side wall 79 has a plurality of tabs 80 formed therein by perforation and arranged in a vertical pattern of pairs. When a partially full box 76 is removed from the vending machine 10, a pair of the tabs 80 just above the top one of the flat items 42 can be pushed inwardly to hold the column of fiat items in place. Similar tabs 80 are formed in the opposite side wall 79 as shown in FIG. 7.

The box 76 has a rear wall 81 that includes a vertically extending opening 82 through which the fiat items 42 can be observed. To the right of the opening 82 there is provided a first indicator 83 whereby the position of the top flat item 42 in the box 76 relative to the indicator 83 shows the number of items remaining in the box. To the left of the opening 82 there is provided a second indicator 84 whereby the position of the top flat item 42 in the box 76 relative to the indicator 84 shows the number of items dispensed from a full box. In this example, the capacity of the box 76 is two hundred forty items. As seen in FIG. 7; the box 76 has a bottom wall 85 with a cutout 86 open to the rear wall 81 for receiving the guide flanges 60 and the slider 55 of the folder slide 49. Also formed in the bottom wall 85 is a pair of apertures 87 through which the support posts 61 extend to contact the bottom flat item 42. The guide flanges 60 and the support posts 61 extend above the upper surface of the bottom wall 85 to raise the lowermost flat item 42 out of contact with the bottom wall. As with the tower 65 described above, the slider 55 overlaps the bottom wall 85 in the forward position to prevent removal of the box 76.

Figure 8:
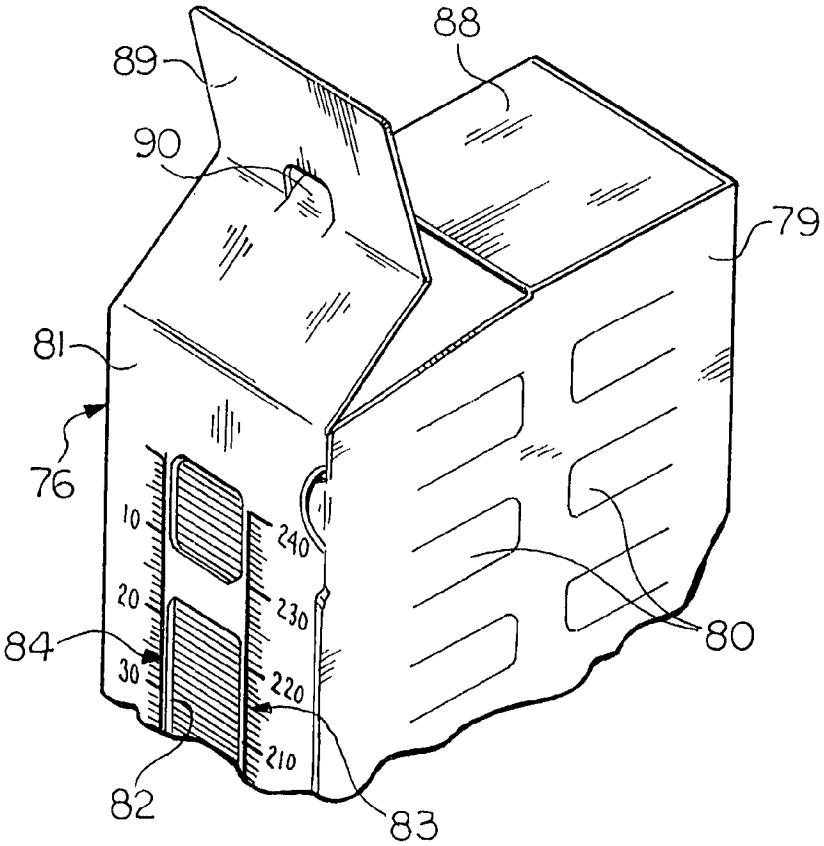
FIG. 8 is a fragmentary rear perspective view of an upper end of the shipping and dispensing box shown in FIG. 6.

There is shown in FIG. 8 a top wall of the box 76 with a fixed front portion 88 and a 10 movable rear portion 89. The rear portion 89 selectively closes an opening, that permits the weight 70 to be inserted into the box 76 on top of the column of flat items 42 without otherwise opening the box. The rear portion 89 can be folded into the box 76 and a tab lock 90 inserted behind the rear edges of the upper flat items to hold the column in place.

Figure 9:
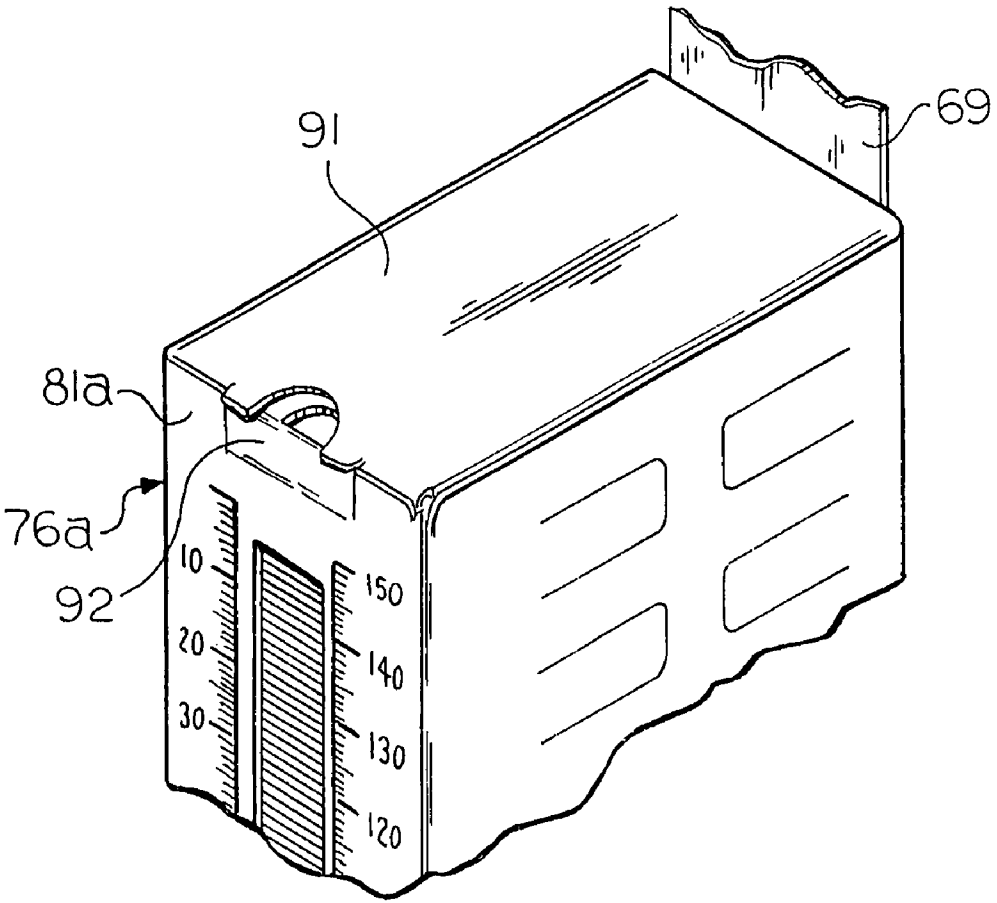
FIG. 9 is a fragmentary rear perspective view of an upper end of an alternate embodiment shipping and dispensing box used with the apparatus shown in FIG. 1.

There is shown in FIG. 9 a top of an alternative box 76*a* that has a capacity of one hundred fifty of the flat items 42 and is similar in construction to the box 76. A top wall 91 is hinged at a front edge to provide access to the interior of the box and can be secured in the closed position shown by engagement with a tab lock 92 provided on an upper edge of the rear wall 81*a*. In an open position, not shown, the outer surface of the top wall 91 cooperates with a front wall of the box 76*a* to function as a full height surface for adhering the display 69.

As explained above, the tower 65 and the boxes 76 and 76*a* are easily removable from the folder slides 49 mounted on the door 34. In the case of a flat item jam, the service person simply opens the door 34 far enough to lift out the tower 65 or box 76, 76*a* to expose the jam and correct the problem in a very short time. In the case of a coin slide jam, the door must be lowered to a point where the flat items would fall out. Thus, either all of the towers are removed, or the associated box is removed and the appropriate tabs 80 on the remaining boxes are pushed in before the door is completely opened.

Figure 10:
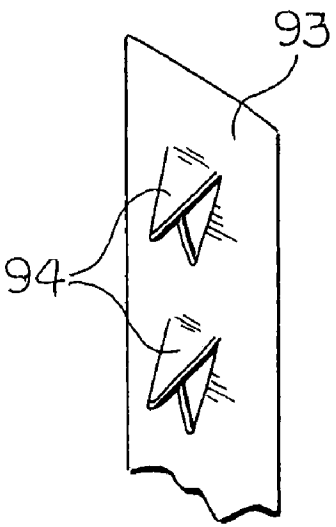
FIG. 10 is a fragmentary perspective view of a retainer strip for use with a shipping/dispensing box used with the apparatus shown in FIG. 1.

There is shown in FIG. 10 an alternative to the tabs 80 provided in the side walls of the box 76. A retainer strip 93 can have a plurality of downwardly extending teeth 94 formed therein arranged in a vertical column. Each tooth 94 has a pointed lower end extending at an angle from a plane of the strip 93. A rear surface of the strip 93 can have an adhesive applied thereto for adhering the strip to an inside surface of one of the side walls 79. The step 93 is formed of a resilient material, such as a plastic, so that the teeth 94 flex inwardly to allow passage of the flat items 42 in a downward direction, but prevent the fiat items from moving upwardly. Appropriately sized retainer strips 93 also could be used in the box 76*a*.

The tabs 80 and the teeth 94 eliminate the need for banding the flat items 42 into packs and permit the boxes 76 and 76*a* to be packed with the flat items by machine instead of by hand. Thus, the flat items 42 can be shipped from the manufacturer and installed in the vending machine 10 without the extra handling required by the prior art vending machines.

Similarly, the strips 93 can be used with the tower 65 to render it transportable while filled with the flat items 42. Although the tower 65 has been described above as being formed of metal, it can be formed of any suitable material including plastic and can be transparent. Thus, the vending machine 10 can be used with the tower 65 as shown in FIG. 4 and serviced conventionally, or it can be used with the boxes 76 and 76*a* and the tower 65 incorporating the strips 93 for time-saving service.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for dispensing flat items comprising:

a housing having a front wail with an upper door opening, at least one intermediate dispensing slot and a lower pan opening formed therein;

a collection pan releasably retained in said pan opening and extending inside said housing;

a pan bag removably retained in said collection pan for receiving coins;

a door positioned in said door opening and pivotally attached to said front wall for movement between open and closed positions;

at least one coin slide mechanism mounted on said door and operable to transfer at least one coin from outside said housing to said pan bag;

a storage means removably mounted on an inside surface of said door for holding a plurality of flat items in a column; and a folder slide mounted on an inside surface of said door adjacent said storage means and coupled to said coin slide mechanism whereby when said storage means holds at least one flat item and said coin slide mechanism is operated to transfer the at least one coin from outside said housing to said pan bag, said coin slide mechanism actuates said folder slide to push the at least one flat item at least partially out of said at least one dispensing slot.

2. The apparatus according to claim 1 wherein said collection pan has at least one of a tab adapted to extend through a slot formed in a rear wall of said housing for receiving a padlock and a lock cooperating with said housing.

3. The apparatus according to claim 1 wherein said pan bag includes a pan shaped bag having a bottom wall with a bag opening formed therein and a pocket shaped bag attached to said bottom wall in communication with said bag opening.

4. The apparatus according to claim 3 wherein said pan bag includes a cord having opposite ends attached to opposed side walls of said pan shaped bag.

5. The apparatus according to claim 1 wherein said storage means is one of a tower and a shipping/dispensing box.

6. The apparatus according to claim 1 including a weight having a metal plate and attached handle, said weight being removably retained in said storage means for resting on top of the column of flat items.

7. The apparatus according to claim 1 wherein said storage means is a shipping/dispensing box having a predetermined number of the flat items stored therein.

8. The apparatus according to claim 1 including a display attached to a front wall of said storage means.

9. The apparatus according to claim 1 wherein said shipping/dispensing box has an indicator means for indicating at least one of a number of the flat items in said box and a number of the flat items dispensed from said box.

10. The apparatus according to claim 1 including a security gate mounted inside said housing adjacent said dispensing slot, said security gate being one of a vertically extending bias plate attached to said folder slide and a horizontally extending spring attached to said door.

11. An apparatus for dispensing flat items comprising:

a housing having a front wail with at least one dispensing slot formed therein;

a storage means removably mounted inside said housing for supporting a plurality of flat items in a column, said storage means comprising a shipping/dispensing box having a bottom wall with an opening formed therein, a top wall rear portion adapted to be folded into an upper end of said box, and a tab lock adapted to be inserted behind a rear edge of the topmost flat items to hold the column in place; and a folder slide mounted on an inside surface of said housing front wall adjacent said storage means, said folder slide having at least one flange extending into said opening and at least one post extending into said opening whereby when said storage means holds at least one flat item, said at least one item is supported by said at least one flange and said at least one post out of contact with said storage means bottom wall.

12. The apparatus according to claim 11 wherein said storage means includes a retaining means for securing a column of the flat items from movement in the storage means.

13. The apparatus according to claim 12 wherein said storage means has opposed side walls and said retaining means comprises a plurality of tabs formed in said side walls, each said tab being adapted to be pushed inwardly.

14. The apparatus according to claim 11 wherein said storage means has an indicator means adjacent for indicating at least one of a number of the flat items in said storage means and a number of the flat items dispensed from said storage means.

15. The apparatus according to claim 11 wherein said storage means has a front wall adapted to receive a display.

16. The apparatus according to claim 15 wherein said front wall has at least one display window formed therein, said at least one display window being aligned with said front wall of said storage means for viewing a display received on said front wall.

17. The apparatus according to claim 16 including a transparent plate mounted inside said housing closing said at least one display window.

18. The apparatus according to claim 12 wherein said retaining means comprises a plurality of flexible teeth extending inwardly from said side walls.

* * * * *